US007084364B2

(12) United States Patent
Mezhinsky

(10) Patent No.: US 7,084,364 B2
(45) Date of Patent: Aug. 1, 2006

(54) DUAL CONTROL FOOTSWITCH ASSEMBLY

(75) Inventor: Victor B. Mezhinsky, Brea, CA (US)

(73) Assignee: Alcon, Inc., Fort Worth, TX (US)

( * ) Notice: Subject to any disclaimer, the term of this patent is extended or adjusted under 35 U.S.C. 154(b) by 0 days.

(21) Appl. No.: 10/986,708

(22) Filed: Nov. 12, 2004

(65) Prior Publication Data

US 2005/0103607 A1 May 19, 2005

Related U.S. Application Data

(60) Provisional application No. 60/519,752, filed on Nov. 13, 2003.

(51) Int. Cl.
*H01H 9/00* (2006.01)

(52) U.S. Cl. ..... 200/310; 200/341

(58) Field of Classification Search ..... 200/52 R, 200/86.5, 61.58 R, 310–314, 341–345; 74/512–514, 74/560, 561
See application file for complete search history.

(56) References Cited

U.S. PATENT DOCUMENTS

| | | | | |
|---|---|---|---|---|
| 4,267,414 | A | 5/1981 | Brueggeman | |
| 4,383,167 | A | 5/1983 | Gmeinder et al. | |
| 4,652,215 | A | 3/1987 | Kuroyanagi et al. | |
| 4,837,857 | A | 6/1989 | Scheller et al. | |
| 4,901,454 | A | 2/1990 | Walkhoff | |
| 4,965,417 | A | 10/1990 | Massie | |
| 4,983,901 | A | 1/1991 | Lehmer | |
| 5,091,656 | A | 2/1992 | Gahn | |
| 5,237,891 | A * | 8/1993 | Lundberg et al. | 74/560 |
| 5,268,624 | A | 12/1993 | Zanger | |
| 5,554,894 | A | 9/1996 | Sepielli | |
| 5,580,347 | A | 12/1996 | Reimels | |
| 5,635,777 | A | 6/1997 | Telymonde et al. | |
| 5,787,760 | A | 8/1998 | Thorlakson | |
| 5,983,749 | A | 11/1999 | Holtorf | |
| 5,990,400 | A | 11/1999 | Hoshino | |
| 6,010,496 | A | 1/2000 | Appelbaum et al. | |
| 6,150,623 | A | 11/2000 | Chen | |
| 6,179,829 | B1 | 1/2001 | Bisch et al. | |
| 6,360,630 | B1 | 3/2002 | Holtorf | |
| 6,452,120 | B1 | 9/2002 | Chen | |
| 6,514,268 | B1 | 2/2003 | Finlay et al. | |
| D478,323 | S | 8/2003 | Peterson et al. | |
| 6,639,332 | B1 | 10/2003 | Metzler et al. | |
| 6,659,998 | B1 | 12/2003 | DeHoogh et al. | |
| 6,674,030 | B1 | 1/2004 | Chen et al. | |
| 6,743,245 | B1 | 6/2004 | Lobdell | |
| 6,784,388 | B1 * | 8/2004 | Braaten | 200/86.5 |
| 6,862,951 | B1 * | 3/2005 | Peterson et al. | 74/560 |
| 2003/0047434 | A1 | 3/2003 | Hanson et al. | |
| 2003/0073980 | A1 | 4/2003 | Finlay et al. | |
| 2003/0213333 | A1 | 11/2003 | McVicar | |
| 2004/0106915 | A1 | 6/2004 | Thoe | |

FOREIGN PATENT DOCUMENTS

| | | |
|---|---|---|
| GB | 1 063 067 A | 3/1967 |
| WO | WO 96/138485 | 5/1996 |

(Continued)

*Primary Examiner*—Michael Friedhofer
*Assistant Examiner*—Lisa Klaus
(74) *Attorney, Agent, or Firm*—Strasburger & Price, LLP

(57) ABSTRACT

A footswitch having a tiltable treadle includes a rotatable heel cup for providing a second proportional control input based on the rotational movement of the rotatable heel cup.

8 Claims, 3 Drawing Sheets

FOREIGN PATENT DOCUMENTS

| | | |
|---|---|---|
| WO | WO 98/08442 | 3/1998 |
| WO | WO 99/14648 | 3/1999 |
| WO | WO 00/12037 | 3/2000 |
| WO | WO 02/01310 | 1/2002 |
| WO | WO 03/053293 | 7/2003 |
| WO | WO 03/053294 | 7/2003 |

* cited by examiner

DUAL CONTROL FOOTSWITCH ASSEMBLY

This application claims priority from Provisional U.S. Patent Application No. 60/519,752, filed Nov. 13, 2003.

FIELD OF INVENTION

This invention relates to footswitches; more particularly, the present invention relates to footswitches used to control apparatus used by physicians, surgeons, dentists, veterinarians, etc., when treating patients.

BACKGROUND

During the use of a complex patient treatment apparatus; for example, the handpiece used when performing ophthalmic surgery, the control of a variety of different subsystems such as pneumatic and electronically driven subsystems is required. Typically, the operation of the subsystems included in a complex patient treatment apparatus is controlled by a microprocessor-driven console. The microprocessor controls within the console receive mechanical inputs from either the operator of the treatment apparatus or from an assistant. A control input device, generically known as a footswitch, is often used for receiving mechanical inputs. These mechanical inputs originate from the movement of the foot of an operator to govern the operation of a subsystem within the patient treatment apparatus. The mechanical inputs from the movement of the foot of the operator are translated into electrical signals which are fed to the microprocessor controls. The electrical signals are then used to control the operational characteristics of a subsystem in a complex patient treatment apparatus.

Examples of footswitches that are designed for receiving mechanical inputs from the movement of the foot of an operator of a complex patient treatment apparatus may be found in U.S. patents, including U.S. Pat. Nos. 4,837,857 (Scheller, et al.), U.S. Pat. No. 4,965,417 (Massie), U.S. Pat. No. 4,983,901 (Lehmer), U.S. Pat. No. 5,091,656 (Gahn), U.S. Pat. No. 5,268,624 (Zanger), U.S. Pat. No. 5,554,894 (Sepielli), U.S. Pat. No. 5,580,347 (Reimels), U.S. Pat. No. 5,635,777 (Telymonde, et al.), U.S. Pat. No. 5,787,760 (Thorlakson), U.S. Pat. No. 5,983,749 (Holtorf), and U.S. Pat. No. 6,179,829 B1 (Bisch, et al.), and in International Patent Application Publication Nos. WO 98/08442 (Bisch, et al.), WO 00/12037 (Chen), and WO 02/01310 (Chen). These aforementioned patents and patent applications focus primarily on footswitches which include a foot pedal or tiltable treadle similar to the accelerator pedal used to govern the speed of an automobile. The movement of the foot pedal or tiltable treadle typically provides a linear control input. Such linear control inputs may be used, for example, for regulating vacuum, rotational speed, power, or reciprocal motion.

In more complex footswitch assemblies, side or wing switches are typically located on a housing on either side of the foot pedal or tiltable treadle. The condition of these side or wing switches is changed by the application of pressure from the front portion of the operator's foot or from the rear portion of the operator's foot. However, given the ever-increasing complexity of patient treatment apparatus, there remains a need in the art to provide yet additional control features on a footswitch, while, at the same time, not making the construction or operation of the footswitch overly complex. It has been found that one of the most usable additional control features for a footswitch would be a second separate proportional control input in addition to the linear control input provided by a single foot pedal or tiltable treadle. There is also a need to assure that the footswitch is ergonomically sound to minimize fatigue of the operator's foot or leg, as such fatigue may cause improper control inputs. Such improper control inputs have the potential of injuring a patient.

SUMMARY

The present invention provides a footswitch assembly which is simple in construction and operation, yet a second separate proportional control input is provided. The second separate proportional control input is associated with rotational movement of the operator's heel on the rear portion of the footswitch. Specifically included in the rear portion of the disclosed footswitch assembly is a heel cup or plate. The heel cup or plate is supported by a circular thrust bearing. This circular thrust bearing under the heel cup or plate enables rotation of the heel cup or plate by rotation of the operator's heel. Such rotation of the heel cup or plate may be accomplished while the foot pedal or tiltable treadle under the front portion of the operator's foot is in any one of a variety of positions with respect to a horizontal plane. Control input from the rotation of the heel cup or plate using the rotational motion afforded by the circular thrust bearing enables a second proportional control output from a potentiometer. The potentiometer is mechanically connected to the heel cup or plate. In an alternate embodiment, a simple on/off switch may be incorporated into the heel cup or plate so that control input from rotation of the heel cup or plate using the circular thrust bearing is not transmitted, unless the switch in the heel cup or plate is activated.

DESCRIPTION OF DRAWING FIGURES

A better understanding of the disclosed dual control footswitch assembly may be had by reference to the attached drawing figures, in which.

DETAILED DESCRIPTION

Figure 1:
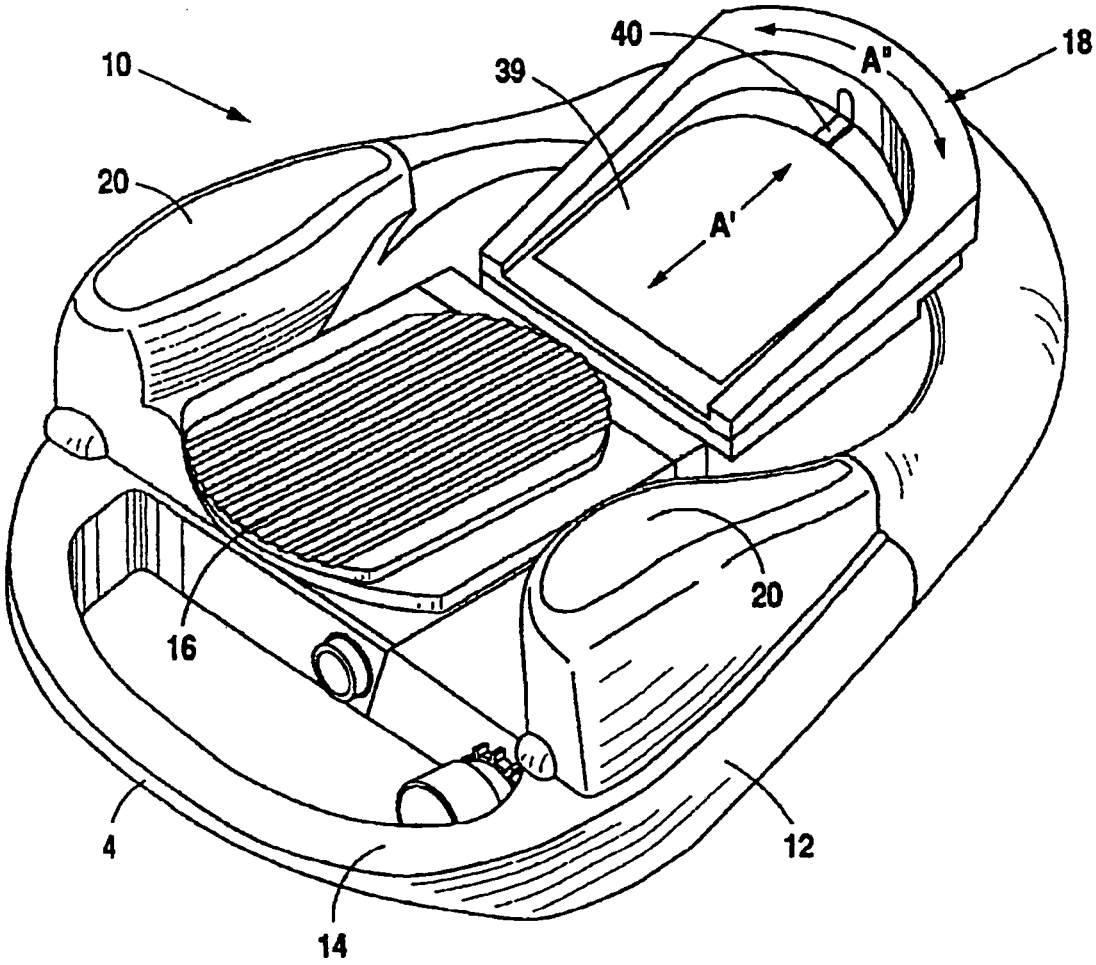
FIG. 1 is a perspective view of the dual control footswitch assembly of the present invention.
Figure 2:
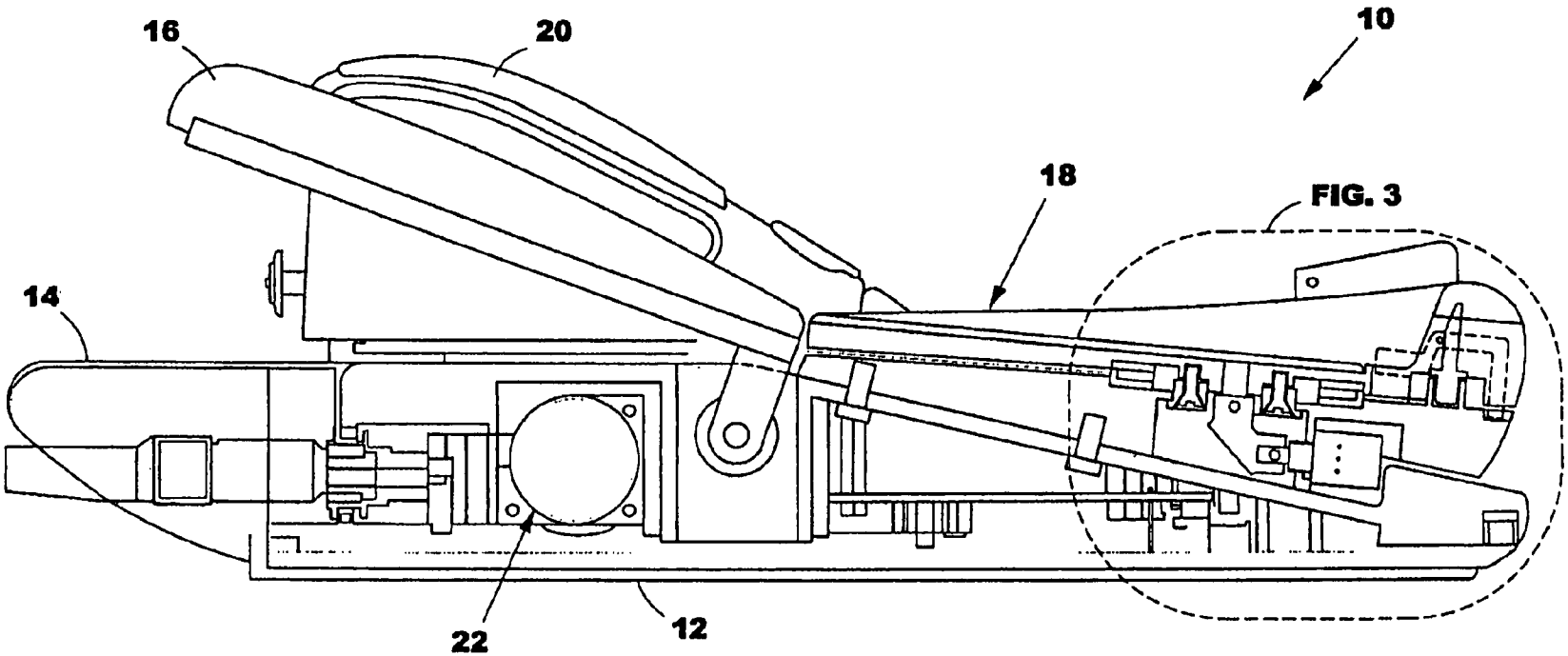
FIG. 2 is an elevational view in partial section of the disclosed footswitch assembly.

As best seen in FIG. 1 and FIG. 2, a preferred embodiment of the footswitch assembly 10 of the present invention generally includes a bottom housing 12, a top housing 14, a foot pedal or tiltable treadle 16, a separate heel cup assembly 18, and a handle 4 positioned in the front. Side or wing switches 20 are placed on the top of the housing 14 on either side of the foot pedal 16.

Attached to the foot pedal or tiltable treadle 16 is a DC motor/encoder assembly 22. The angular or pitch position of the foot pedal or treadle 16, which is tiltable with respect to a horizontal plane or to a neutral or home plane, provides the first system for converting of mechanical input from movement of the operator's foot into an electrical signal. Thus, the pitch movement of the foot pedal or tiltable treadle 16, typically in a downward direction, provides a control input. The control input is preferably a linear control input. However, when a variable high input and a constant low input is satisfactory, the neutral or home plane may provide the constant low input, and depression of the foot pedal may be used for the variable high input.

As shown in the drawing figures, the footswitch assembly 10 of the present invention provides a second separate proportional control input. This second separate proportional control input utilizes the heel cup assembly 18 which enables an arcuate movement. As shown in the drawing figures, the heel cup assembly 18 is positioned at the rear portion of the footswitch 10 to engage the heel of the operator. The heel cup assembly 18 is positioned over a thrust bearing assembly 28. Such construction and positioning allows the operator to rotate the heel cup assembly 18 through an arcuate path while the operator's heel effectively remains in the same spot with respect to the footswitch assembly 10.

Figure 3:
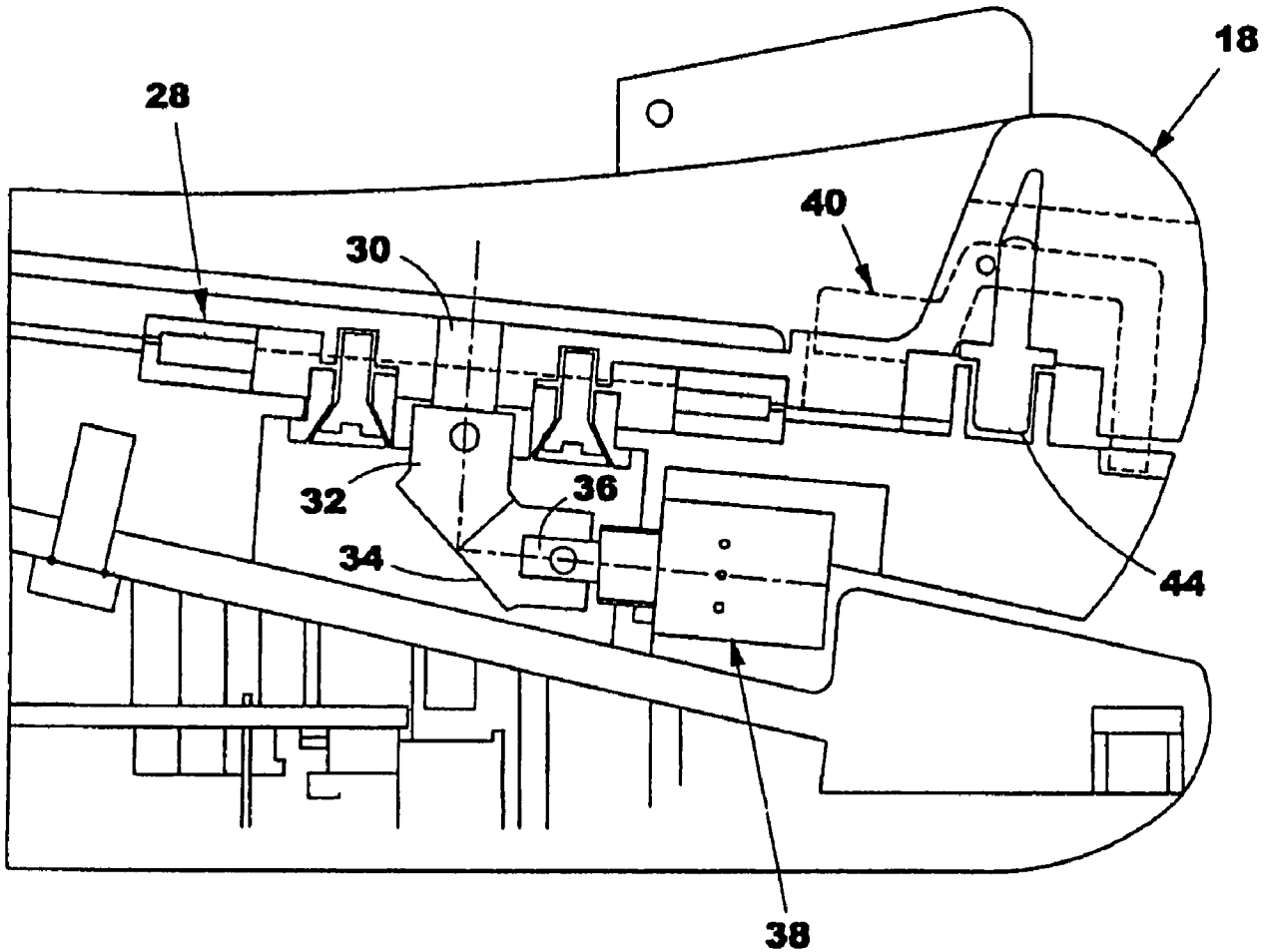
FIG. 3 is an enlarged elevational view in partial section of the encircled portion of the heel support assembly shown in FIG. 2.

In the preferred embodiment and as shown in FIG. 3, a shaft 30 is attached to the bottom of the heel cup assembly 18. The shaft 30 is connected to a first bevel gear 32. The first bevel gear 32 is positioned to be in mating engagement with a second bevel gear 34. As the heel cup assembly 18 is rotated in an arcuate motion as shown by the arrow marked A" in FIG. 1, the shaft 30 also rotates. This rotational motion of the heel cup assembly 18 causes rotation of the first bevel gear 32. The contact between the teeth on the first bevel gear 32 and the teeth on the second bevel gear 34 rotates a shaft 36 which is connected to an angular position potentiometer 38. This mechanical input to the angular position potentiometer 38 provides an electrical signal. The electrical signal from the potentiometer 38 is the second control signal. This control signal may be either linear or non-linear. In an alternate construction, the potentiometer 38 could be placed directly under the heel of the operator.

To further enhance operator control of the second control signal, in an alternate embodiment, a simple on/off switch, well known to those of ordinary skill in the art, may be included in the heel cup assembly 18 to activate the signal output from the potentiometer 38. Alternatively, such on/off switches could also be used to prevent inadvertent activation of the side switches 20. Such on/off switch may be a slide switch moving along a linear path within the heel cup assembly 18, as is designated by the arrow marked A' illustrated in FIG. 1.

In yet another embodiment, heel cup assembly 18 may include a plate 39 (FIG. 1) that is slidable along the linear path marked by arrow A' when force is applied by the operator's foot. This movement of the plate 39 also actuates the on/off switch. The on/off switch may be a Hall effect sensor. By use of the on/off switch, the operator will be able to change the condition of this switch irrespective of the rotational position of the heel cup assembly 18 or the pitch position of the treadle 16.

In still yet another embodiment, a mechanical or electrical latching mechanism 40, well known to those of ordinary skill in the art, may be included to retain the heel cup assembly 18 in a predetermined location or to release the heel cup assembly 18 to allow rotation.

In the preferred embodiment, a return spring 44 is included to allow the entire heel cup assembly 18 to return it to a home or neutral position.

While the present system and method has been disclosed according to the preferred embodiment of the invention, those of ordinary skill in the art will understand that other embodiments have also been enabled. Such other embodiments shall fall within the scope and meaning of the appended claims.

I claim:

1. A footswitch for receiving operator inputs, said footswitch comprising:

a base assembly;

a pivotable treadle mounted on said base assembly for receiving a pitch movement input and providing a first control output;

a heel cup mounted on said base assembly, said heel cup constructed and arranged for placement under the operator's heel;

said heel cup being positioned over means for enabling changing the rotational position of said heel cup;

means for translating said rotational position of said heel cup into a second separate proportional control output, said second proportional control output being mechanical input provided to a potentiometer.

2. The footswitch as defined an claim 1 wherein a thrust bearing enables said change in said rotational position of said heel cup.

3. The footswitch defined in claim 1 wherein a set of bevel gears is used to transmit said rotational position of said heel cup to said potentiometer.

4. The footswitch as defined in claim 1 wherein said potentiometer is activated by a switch located in said heel cup.

5. The footswitch defined in claim 4 wherein the physical condition of the said switch is changed by the movement of a plate located in said heel cup.

6. The footswitch defined in claim 4 wherein said switch is used to deactivate other portions of the footswitch.

7. The footswitch defined in claim 1 further including a latching mechanism for preventing changing said rotational position of said heel cup.

8. The footswitch as defined in claim 1 further including a spring bias for returning said heel cup to a home or neutral position.

* * * * *